United States Patent [19]

Amtmann et al.

[11] 4,331,876

[45] May 25, 1982

[54] ONE- OR TWO-PULSE X-RAY DIAGNOSTIC GENERATOR

[75] Inventors: Heribert Amtmann, Langensendelbach; Karlheinz Broenner; Johann Seissl, both of Erlangen, all of Fed. Rep. of Germany

[73] Assignee: Siemens Aktiengesellschaft, Berlin & Munich, Fed. Rep. of Germany

[21] Appl. No.: 134,097

[22] Filed: Mar. 26, 1980

[30] Foreign Application Priority Data

Apr. 30, 1979 [DE] Fed. Rep. of Germany ..... 2917594

[51] Int. Cl.[3] ..... H05G 1/30

[52] U.S. Cl. ..... 250/402; 250/408

[58] Field of Search ..... 250/402, 408, 409, 421; 315/307

[56] References Cited

U.S. PATENT DOCUMENTS 3,846,633 11/1974 Romandi ..... 250/408
4,188,536 2/1980 Piazza ..... 250/402
4,191,891 3/1980 Amtmann et al. ..... 250/409
4,221,968 9/1980 Franke ..... 250/409

FOREIGN PATENT DOCUMENTS 1961621 1/1978 Fed. Rep. of Germany .

*Primary Examiner*—Bruce C. Anderson
*Attorney, Agent, or Firm*—Hill, Van Santen, Steadman, Chiara & Simpson

[57] ABSTRACT

In an exemplary embodiment, a rectifier bridge is inserted in the primary circuit of the high voltage transformer and has an electronic circuit for adjusting the primary current to adjust the amplitude of the x-ray tube voltage pulse waveform. The comparator of the control loop cooperates with a storage circuit which is connected to a release circuit which releases it by means of a release pulse in a short time interval within a half wave of the x-ray tube voltage waveform for storing an instantaneous value of the error until the next release pulse. The storage circuit drives the electronic voltage adjusting circuit to adjust the pulse amplitude without distorting its waveform.

1 Claim, 4 Drawing Figures

ONE- OR TWO-PULSE X-RAY DIAGNOSTIC GENERATOR

BACKGROUND OF THE INVENTION

The invention relates to a one- or two-pulse x-ray diagnostic generator which contains a high voltage transformer with a primary winding connected to the mains and a secondary winding which supplies the x-ray tube, as well as a control loop for controlling the amplitude of the high voltage, in which a rectifier group traversed by primary current is inserted in the primary circuit of the high voltage transformer in the form of a bridge circuit, electronic adjusting means for the x-ray tube voltage being arranged in the direct current branch of said rectifier group.

An x-ray diagnostic generator with essential features of this type which is generally employable, i.e., not only for one- or two-pulse operation, is described in the German LP No. 1,961,621. In this device, a continuous comparison of the actual value of the x-ray tube voltage with the rated value ensues. If this known x-ray diagnostic generator is designed as a one- or two-pulse generator, then a continuous comparison of the actual value of the x-ray tube voltage with the rated value also ensues, as does a continuous control based on such continuous comparison. This leads to the fact that the supply voltage of the x-ray tube is no longer formed by sine half waves but that the sine half waves of the mains are converted to be approximately trapezoidal. However, it is desired that the voltage at the x-ray tube have a specific waveform which is only changed in amplitude during the control operation.

SUMMARY OF THE INVENTION

The object of the invention is to design a one- or two-pulse x-ray diagnostic generator of the type initially cited such that the waveform of the x-ray tube voltage is not or is only slightly changed during the control operation.

This object is inventively achieved in that a storage circuit is allocated to the comparator of the x-ray tube voltage control loop, which storage circuit is connected to a release circuit which, by means of a release pulse, activates the storage circuit during a short time interval within a half wave of the x-ray tube voltage for storing the instantaneously occurring value of the comparator output until the next release pulse; and in that the storage circuit drives the electronic adjustment means in accordance with such stored value. In the inventive x-ray diagnostic generator, an output value representing a comparison of the actual value of the x-ray tube voltage with the setpoint value is transmitted only in a short time interval within a half wave of the x-ray tube voltage. After each such comparison, the adjustment magnitude remains unchanged until the next comparison. By so doing, a very precise conformity to a desired specific waveform of the x-ray tube voltage is obtained. A particularly precise sine shape of the x-ray tube voltage is obtained if, after the rated/actual value comparison within a half wave of the x-ray tube voltage, the amplitude of the succeeding half wave is first changed according to the result of this comparison.

In the following, the invention is described in greater detail on the basis of an exemplary embodiment illustrated on the accompanying drawing sheet, and other objects, features and advantages will be apparent from this detailed disclosure and from the appended claims.

DETAILED DESCRIPTION

Figure 1:
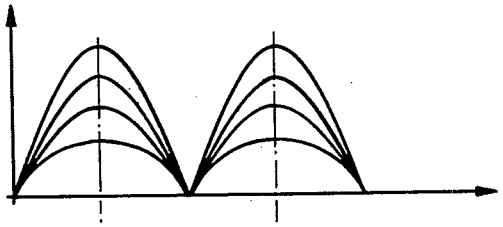
FIGS. 1 and 2 show waveforms as a function of time for explaining the inventive idea, the waveforms being shown with a common time frame such that vertically aligned portions correspond to the same point in time.
Figure 2:
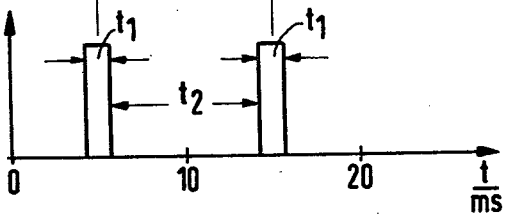

In FIG. 1, the desired waveform as a function of time of the x-ray tube voltage of a two-pulse x-ray diagnostic generator is illustrated for various amplitudes. FIG. 2 illustrates the teaching that a rated/actual value comparison for the control of the amplitude of the x-ray tube voltage is to be transmitted only during the time intervals t1. The magnitude of the control value so transmitted is constant between two time intervals t1 and corresponds to the comparator output during the preceding comparison interval t1. It follows therefrom that, when the comparison is undertaken at the respective voltage maximum as indicated by the relationship of FIGS. 1 and 2, the x-ray tube voltage rises substantially according to a sinusoidal function until the voltage maximum, the waveform in the primary circuit then being slightly changed depending upon the conditions as it continues according to a substantially sinusoidal function. The waveform of the voltage half waves at the x-ray tube therefore always largely correspond to the sine shape. A precise maintenance of the sine shape is possible when, after a comparison of the actual value of the x-ray tube voltage with the rated value, for example, at the voltage maximum according to FIG. 2, the amplitude of the following half wave in the primary circuit is selected in such manner that the deviation (referred to the preceding comparison) becomes zero.

Figure 3:
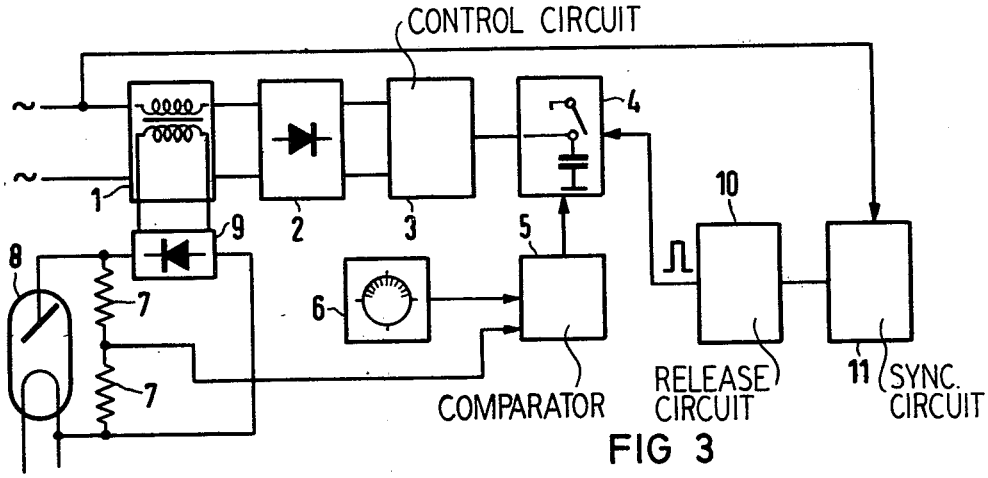
FIG. 3 is an electric circuit diagram showing an x-ray diagnostic generator according to the invention.

A high voltage transformer 1 which is fed from the mains (e.g. from a commercial power network at 60 Hertz) is illustrated in FIG. 3. Its primary winding lies in series with a rectifier 2 having the form of a full wave bridge circuit. A control circuit 3 for adjusting the x-ray tube voltage is connected across the direct current terminals of the bridge circuit. The control circuit 3 is controlled by a storage circuit 4 which periodically receives a new error value from a comparator 5. The comparator 5 is connected to a rated value generator 6 for establishing a desired setpoint value for the x-ray tube voltage as well as to a voltage divider 7 in the high voltage circuit, at which an actual value signal for representing the actual value of voltage at an x-ray tube 8 is tapped. The x-ray tube 8 is supplied by a high voltage rectifier 9 which is connected to the secondary winding of the high voltage transformer 1.

The storage circuit 4 is driven by a pulse circuit 10 which is driven by a synchronization circuit 11.

The control circuit 3 influences the primary voltage of the high voltage transformer 1 and, thus, also the x-ray tube voltage. The magnitude of the primary current is determined by the storage circuit 4. According to FIG. 2, the storage circuit 4 is briefly actuated by the release circuit 10 during the times t1, i.e., in the area of the respective voltage maximum of each x-ray tube half wave voltage pulse and samples the error value instantaneously being supplied by the comparator 5. It then stores this comparator output value until the next voltage maximum; i.e. the adjustment magnitude stored by the storage circuit 4 is constant during the time interval t2 (FIG. 2).

Figure 4:
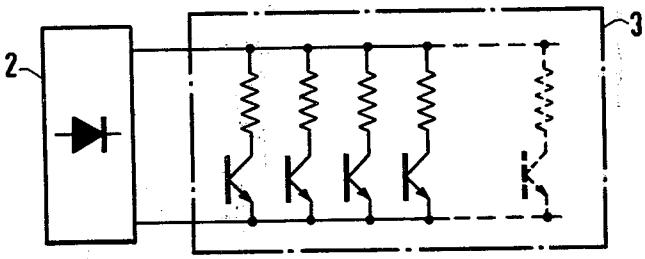
FIG. 4 is a circuit diagram showing a detail of the x-ray diagnostic generator according to FIG. 3.

It follows from FIG. 4 that the control circuit 3 can consist of the parallel connection of a plurality of series networks each consisting of a switching transistor and a resistor. In accord with the magnitude of the output signal of the storage circuit 4, the switching transistors are thereby driven so that a total resistance is switched in series with the primary winding of the high voltage transformer 1, at which resistance value the desired value of x-ray tube voltage is to be obtained.

It is also possible to design the control circuit 3 as a direct current source whose voltage is directed opposite to the output voltage of the rectifier 2 and is set in accord with the error value measured at the respective voltage maximum. A circuit arrangement of this type is described in the German LP No. 1,961,621 already cited.

It will be apparent that many modifications and variations may be effected without departing from the scope of the novel concepts and teachings of the present invention.

Referring to FIG. 4, it will be apparent that each transistor may be rendered conductive in accordance with the magnitude and polarity of the stored control value at storage circuit 4, so that the primary current amplitude is adjusted according to the magnitude and polarity of the control value, thus providing a continuous analog type of adjustment of primary current which may be effective essentially throughout the time interval t2, FIG. 2.

Alternatively, the number of transistors of FIG. 4 which are turned on may be a function of the magnitude and polarity of the stored control value (one-half of the transistors being conductive for a zero stored error value) so that respective discrete primary currents are selectable according to the magnitude and polarity of the stored control value. The selected number of conductive transistors may be such that the setpoint value of high voltage pulse magnitude will be obtained, even for a maximum error, within the time interval t2, FIG. 2.

If the desired number of transistors are turned on in response to a newly stored error value in the vicinity of the time t=10 milliseconds, FIG. 2, for a 50 Hertz waveform as shown in FIGS. 1 and 2, then the correction acts relatively uniformly over the interval from t=10 to t=20 milliseconds, FIGS. 1 and 2, to insure a substantially symmetrical essentially sinusoidal high voltage pulse in spite of the control action.

We claim as our invention:

1. A pulse type x-ray diagnostic generator comprising an x-ray tube, a high voltage transformer with a primary winding for connection to the mains and a secondary winding, said secondary winding having x-ray tube supply means connected with the x-ray tube for supplying a high voltage pulse waveform with a limited number of pulses of high voltage to the x-ray tube, control loop means for controlling the amplitude of the high voltage pulse waveform, a rectifier bridge circuit connected with the primary winding of the high voltage transformer and having direct current terminals, electronic control means for adjusting the x-ray tube voltage, being connected with the direct current terminals of said bridge rectifier circuit, said control loop means comprising a comparator connected with said x-ray tube supply means and operable for supplying an output error value in accordane with the error between a setpoint value representing a desired amplitude of said high voltage pulse waveform and an actual value representing the actual instantaneous amplitude of said high voltage pulse waveform, storage circuit means connected with said comparator for receiving said output error value therefrom, a release circuit synchronized with the mains frequency and operable in successive error value storage cycles to control said storage circuit means to store an output error value occurring at a time interval (t1) within a half wave of the x-ray tube high voltage pulse waveform, and means connecting said storage circuit means with said electronic control means such that the electronic control means is operable after each error value storage cycle for adjusting the x-ray tube voltage in accordance with the output error value stored by said storage circuit means.

* * * * *